US007578882B2

(12) United States Patent
Harris et al.

(10) Patent No.: US 7,578,882 B2
(45) **Date of Patent: *Aug. 25, 2009**

(54) MODULE, NOZZLE AND METHOD FOR DISPENSING CONTROLLED PATTERNS OF LIQUID MATERIAL

(75) Inventors: Michael W. Harris, Cumming, GA (US); Hubert Kufner, Lunenburg (DE); Joel E. Saine, Dahlonega, GA (US)

(73) Assignee: Nordson Corporation, Westlake, OH (US)

( * ) Notice: Subject to any disclaimer, the term of this patent is extended or adjusted under 35 U.S.C. 154(b) by 776 days.

This patent is subject to a terminal disclaimer.

(21) Appl. No.: 10/760,911

(22) Filed: Jan. 20, 2004

(65) Prior Publication Data

US 2004/0144494 A1 Jul. 29, 2004

Related U.S. Application Data

(60) Provisional application No. 60/441,749, filed on Jan. 22, 2003.

(51) Int. Cl.

| | |
|---|---|
| ***B05B 13/02*** | (2006.01) |
| ***B05C 5/00*** | (2006.01) |
| ***B05C 3/12*** | (2006.01) |
| ***A47L 5/00*** | (2006.01) |
| ***B65H 57/04*** | (2006.01) |

(52) U.S. Cl. ..... 118/325; 118/420; 118/72; 15/309.1; 242/157 R

(58) Field of Classification Search ..... 118/420, 118/325, 313, 63, 410, 411; 427/208.6, 296, 427/290; 156/578, 359, 244.11; 239/294, 239/296, 298, 104, 106; 15/309.1; 18/72
See application file for complete search history.

(56) References Cited

U.S. PATENT DOCUMENTS

| | | | | |
|---|---|---|---|---|
| 2,841,020 | A * | 7/1958 | Van Deventer, IV | 474/171 |
| 3,997,308 | A | 12/1976 | Drummond et al. | 65/11 |
| 4,031,854 | A | 6/1977 | Sprague, Jr. | |
| 4,048,861 | A | 9/1977 | Woidke et al. | 74/56 |
| 4,135,903 | A | 1/1979 | Ohsato et al. | |

(Continued)

FOREIGN PATENT DOCUMENTS

EP 0097414 A1 1/1984

(Continued)

OTHER PUBLICATIONS

European Patent Office, European Search Report in Corresponding EP Application No. 04001330, Feb. 19, 2007.

(Continued)

*Primary Examiner*—Yewebdar T Tadesse
(74) *Attorney, Agent, or Firm*—Wood, Herron & Evans, L.L.P.

(57) ABSTRACT

A liquid dispensing module and nozzle or die tip for discharging at least one liquid filament. The nozzle includes a strand guide for guiding a substrate past the nozzle. The strand guide is a concave or rounded notch in the nozzle which receives and aligns a strand to allow accurate placement of a liquid such as adhesive.

14 Claims, 14 Drawing Sheets

U.S. PATENT DOCUMENTS

| | | | | |
|---|---|---|---|---|
| 4,185,981 | A | 1/1980 | Ohsato et al. | |
| 4,222,758 | A | 9/1980 | Stotler et al. | 65/11 |
| 4,666,542 | A | 5/1987 | De Jonckheere | |
| 4,801,051 | A | 1/1989 | Lewis et al. | 222/309 |
| 4,801,345 | A | 1/1989 | Dussaud et al. | |
| 4,842,666 | A | 6/1989 | Werenicz | |
| 4,844,003 | A | 7/1989 | Slautterback et al. | |
| 5,171,512 | A | 12/1992 | Mende et al. | |
| 5,267,693 | A | 12/1993 | Dickey | |
| 5,277,344 | A | 1/1994 | Jenkins | 222/504 |
| 5,342,647 | A | 8/1994 | Heindel et al. | |
| 5,406,782 | A * | 4/1995 | Inuyama et al. | 57/284 |
| 5,540,774 | A | 7/1996 | Smitherman | 118/315 |
| 5,553,758 | A | 9/1996 | Melendy et al. | |
| 5,645,220 | A | 7/1997 | Hohndorf | |
| 5,785,258 | A | 7/1998 | Akin et al. | |
| 5,882,573 | A | 3/1999 | Kwok et al. | |
| 5,902,540 | A | 5/1999 | Kwok | |
| 5,904,298 | A | 5/1999 | Kwok et al. | |
| 5,921,476 | A | 7/1999 | Akin et al. | |
| 6,067,928 | A | 5/2000 | Holzer, Jr. et al. | 118/33 |
| 6,077,375 | A | 6/2000 | Kwok | 156/161 |
| 6,250,357 | B1 | 6/2001 | Niedermeyer | |
| 6,253,957 | B1 | 7/2001 | Messerly et al. | |
| 6,311,899 | B1 | 11/2001 | Hidaka et al. | |
| 6,435,425 | B1 * | 8/2002 | Saidman | 239/290 |
| 6,911,232 | B2 | 6/2005 | Crane et al. | |
| 7,118,558 | B2 | 10/2006 | Wu et al. | |
| 7,175,108 | B2 | 2/2007 | Saine | |
| 7,255,292 | B2 | 8/2007 | Saidman | |
| 2001/0022155 | A1 | 9/2001 | Nakamura | |
| 2002/0136833 | A1 * | 9/2002 | Riney | 427/356 |
| 2003/0089447 | A1 | 5/2003 | Molee et al. | |
| 2003/0173018 | A1 | 9/2003 | Harris | |
| 2003/0173024 | A1 | 9/2003 | Hayder et al. | |
| 2006/0251806 | A1 | 11/2006 | Brock et al. | |

FOREIGN PATENT DOCUMENTS

| | | | |
|---|---|---|---|
| EP | 0322538 | A1 | 7/1989 |
| EP | 0372120 | A2 | 6/1990 |
| EP | 0380781 | A2 | 8/1990 |
| EP | 0792744 | A2 | 9/1997 |
| EP | 1176232 | A1 | 1/2002 |
| GB | 2118021 | A | 10/1983 |
| JP | 61152801 | A | 7/1986 |
| JP | 11244774 | A | 9/1999 |
| JP | 2001259497 | A | 9/2001 |
| JP | 2001347209 | A | 12/2001 |
| WO | 9604874 | A1 | 2/1996 |
| WO | WO 99/54057 | | 10/1999 |

OTHER PUBLICATIONS

European Patent Office, Supplementary European Search Report in Corresponding EP Application No. 03721603, Feb. 8, 2007.

ITW Dynatec™, *Integra Elastic Strand Coating System*, Website, 3 pgs., undated.

John M. Riney, *Guide System for Positioning an Elongated Strand in a Liquid Dispensing Environment*, U.S. Patent Application Publication No. 2002/O136833, Publication Date: Sep. 26, 2002.

Charles A. Gressett, Jr. et al., *Universal Dispensing System for Air Assisted Extrusion of Liquid Filaments*, U.S. Patent Application Publication No. 2002/O134858; Publication Date: Sep. 26, 2002.

Syang-Peng Rwei, Dog-Legging in the Melt Spinning Process, Polymer Engineering and Science, vol. 38, No. 2, pp. 341-347, Feb. 1998.

J&M Laboratories, Durastitch (TM) Technology, New Product Release Manual, Feb. 1997.

Nordson Corporation, Nordson Debuts New Look, New Products at INDEX '99, trends published by Nordson Corporation for the Nonwovens Industry, vol. 11, No. 1, Apr. 1999, pp. 1-4.

Rajiv S. Rao et al., Vibration and Stability in the Melt Blowing Process, Ind. Eng. Chem., 32, pp. 3100-3111, 1993.

Alan Ramspeck, Declaration of Alan Ramspeck in U.S. Appl. No. 11/121,894, Oct. 2, 2007.

U.S. Patent and Trademark Office, Office Action in U.S. Appl. No. 11/121,894, Oct. 11, 2007.

U.S. Patent and Trademark Office, Office Action in U.S. Appl. No. 11/276,736, Apr. 4, 2008.

* cited by examiner

MODULE, NOZZLE AND METHOD FOR DISPENSING CONTROLLED PATTERNS OF LIQUID MATERIAL

CROSS-REFERENCE TO RELATED APPLICATIONS

This application claims the benefit of U.S. Provisional Application Ser. No. 60/441,749, filed on Jan. 22, 2003 (abandoned), and is related to U.S. patent application Ser. No. 10/294,867, now U.S. Pat. No. 6,911,232. The disclosures of these documents are hereby incorporated by reference herein.

FIELD OF THE INVENTION

The present invention generally relates to a liquid material dispensing apparatus and nozzle and, more specifically, to an apparatus and nozzle for dispensing controlled patterns of liquid adhesive strands or filaments.

BACKGROUND OF THE INVENTION

Many reasons exist for dispensing liquid adhesives, such as hot melt adhesives, in the form of a thin filament or strand with a controlled pattern. Conventional patterns used in the past have been patterns involving a swirling effect of the filament by impacting the filament with a plurality of jets of air. This is generally known as controlled fiberization or CF in the hot melt adhesive dispensing industry. Controlled fiberization techniques are especially useful for accurately covering a wider region of a substrate with adhesive dispensed as single filaments or as multiple side-by-side filaments from nozzle passages having small diameters, such as on the order of 0.010 inch to 0.060 inch. The width of the adhesive pattern placed on the substrate can be widened to many times the width of the adhesive filament itself. Moreover, controlled fiberization techniques are used to provide better control of the adhesive placement. This is especially useful at the edges of a substrate and on very narrow substrates, for example, such as on strands of material, such as Lycra®, used in the leg bands of diapers. Other adhesive filament dispensing techniques and apparatus have been used for producing an oscillating pattern of adhesive on a substrate or, in other words, a stitching pattern in which the adhesive moves back-and-forth generally in a zig-zag form on the substrate. Some types of these dispensers or applicators have a series of liquid and air orifices arranged on the same plane.

Various types of nozzles or die tips, such as those of the type described above, have been used to dispense adhesive filaments onto one or more elastic strands. For such applications, the strand or strands typically need to be guided at specific spaced apart positions as the adhesive is discharged onto the strand or strands. Even a single strand needs to be guided and stabilized to ensure accurate placement of the adhesive on the strand. For this purpose, strand guides may take the form of rollers which are fixed to the dispensing module or some other fixed structure. While this works appropriately in many situations, the strand guides do present additional expense and spacing considerations. Also, the strand guides may cause airborne contaminants, such as dust or fiber, to accumulate on the strand at the interface between the guide and the strand. Accumulated debris of this type can then collect into a mass with the adhesive and become smeared or otherwise deposited onto a substrate being joined with the strand. This can reduce the quality of the resulting product.

It would therefore be desirable to provide a nozzle guide which reduces or eliminates the problems noted above while, at the same time, achieving further advantages and advancements over the existing technology.

SUMMARY OF THE INVENTION

The invention provides an adhesive applicator or module that results in repeatable filament orientation with improved placement control of liquid, such as adhesive, on a moving strand. The applicator includes a nozzle for dispensing liquid adhesive onto a strand preferably in a controlled pattern. The nozzle includes a nozzle body having a liquid supply port and a process air supply port. A liquid discharge passage is connected in fluid communication with the liquid supply port, and a plurality of process air discharge passages are connected in fluid communication with the process air supply port. In accordance with a main aspect of the invention, a notch is formed in the nozzle body and is configured to receive and guide the strand along its path of movement. The notch is positioned adjacent to the liquid and process air discharge passages and comprises at least one rounded, concave surface for engaging the strand.

The notch includes an entrance end and an exit end with the path of movement extending preferably straight away from the exit end. The concave surface is angled away, in either a straight or curved manner, from the portion of the path of movement which extends away from the exit end. Preferably, the concave surface is angled away from that exit portion of the path of movement in a direction toward the connected valve module at the entrance end of the notch. Further, the entrance end of the notch is preferably wider in a direction transverse to the path of movement than the exit end. These features serve to self-center the strand with respect to the liquid discharge passage just prior to the deposition of the liquid onto the strand. In the preferred embodiment, the strand is surrounded on three sides by concave surface portions of the notch, but preferably has minimal contact with these surfaces to reduce frictional heat build-up. Although the preferred embodiment of the nozzle includes process air passages, it will be understood that the inventive principles are equally applicable to other dispensing apparatus that do not impinge the discharged liquid with process air. The invention further contemplates the methods of use provided by the nozzle and applicator discussed above.

These and other features, objects and advantages of the invention will become more readily apparent to those of ordinary skill in the art upon review of the following detailed description, taken in conjunction with the accompanying drawings.

DETAILED DESCRIPTION OF PREFERRED EMBODIMENTS

Figure 1:
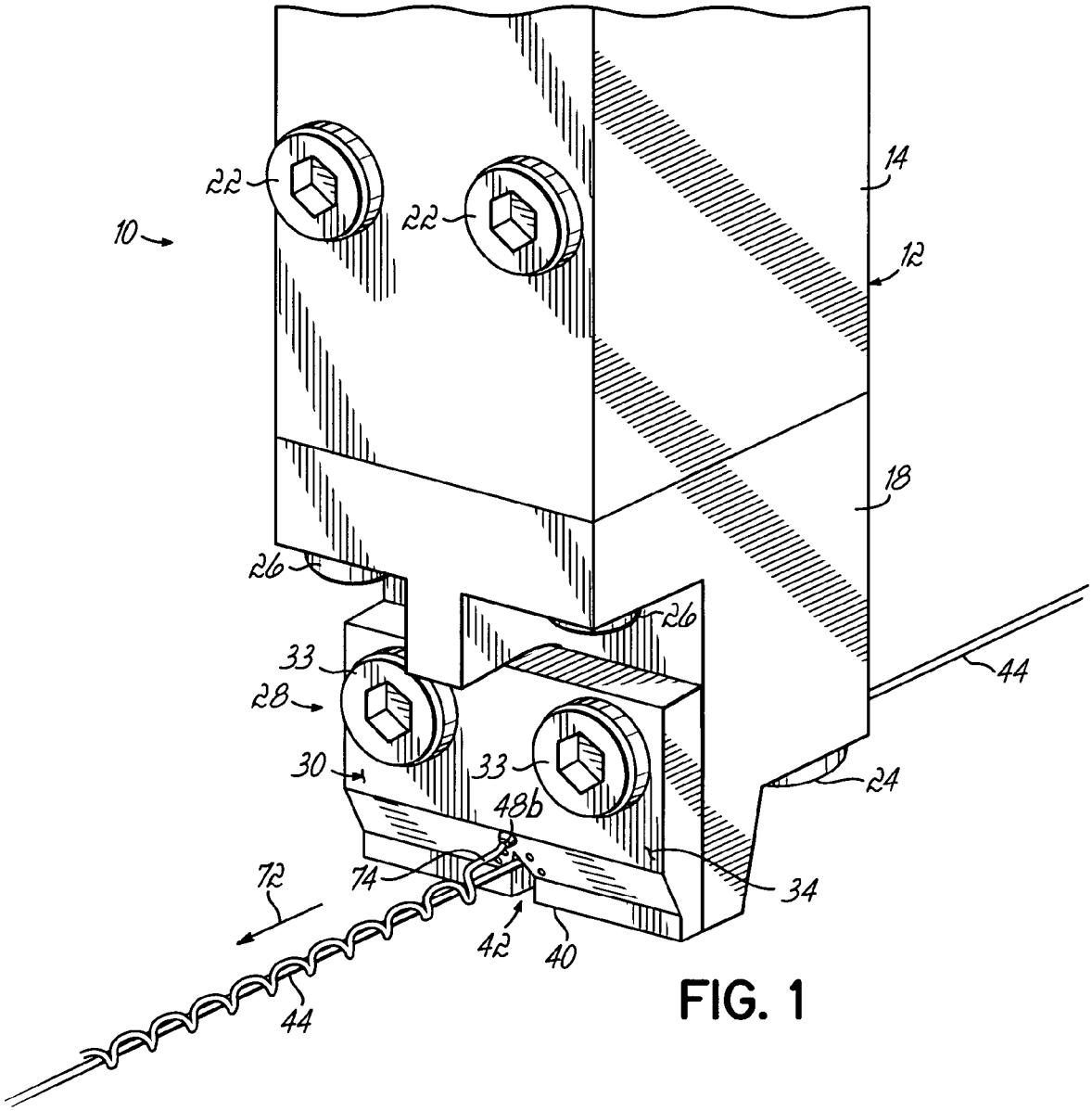
FIG. 1 is a perspective view of a dispensing module including one nozzle or die tip constructed in accordance with a preferred embodiment of the invention.
Figure 2:
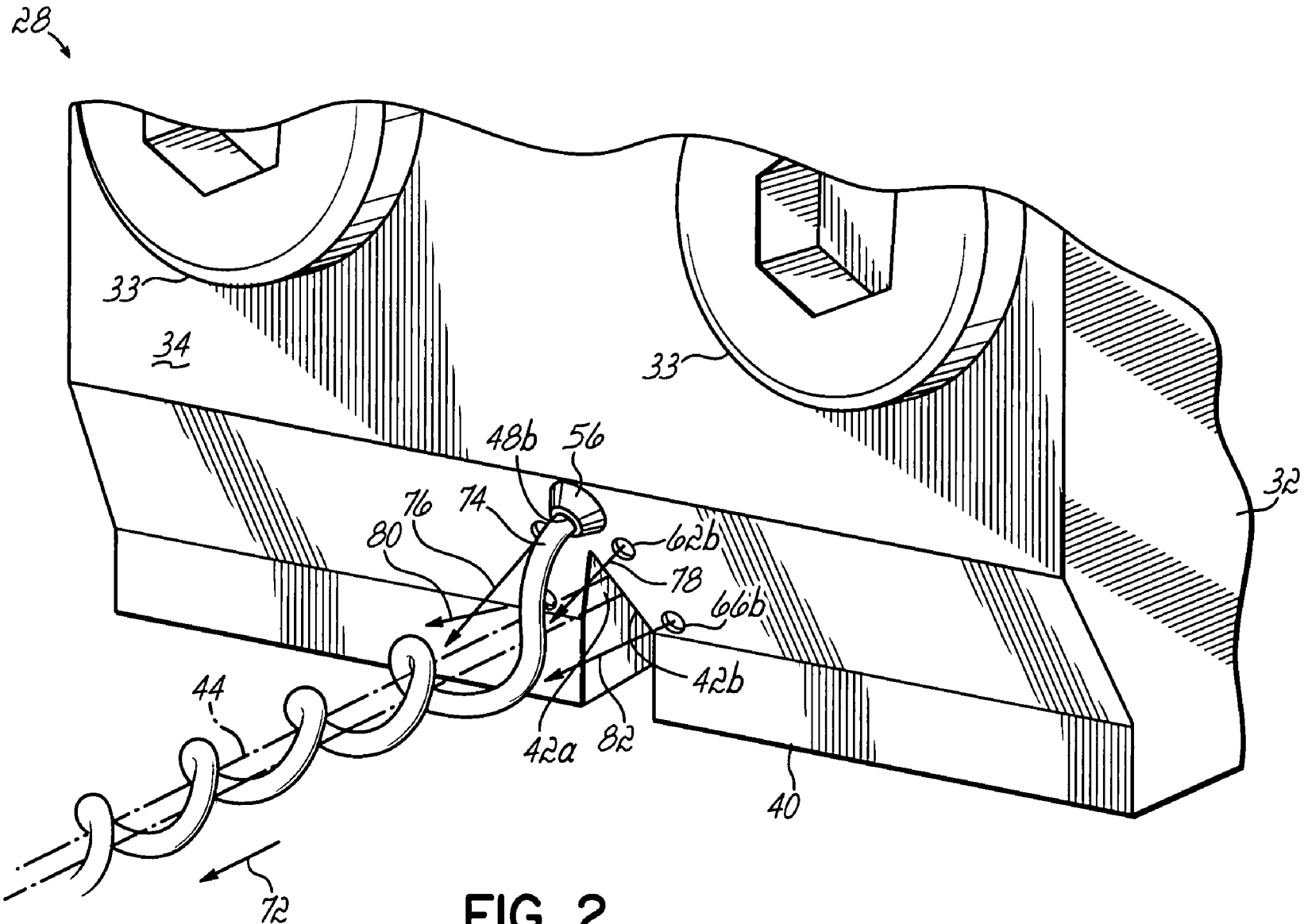
FIG. 2 is an enlarged perspective view of the nozzle or die tip of FIG. 1.

Referring first to FIGS. 1 and 2, an exemplary dispensing module 10 of the present invention is shown. Dispensing module 10 generally comprises a module body 12 including a central body portion 14 and a lower body portion 18. An upper cap (not shown) is secured to central body portion 14 by fasteners (not shown). Central body portion 14 includes fasteners 22 for securing module 10 to a suitable support, such as a manifold (not shown) which supplies liquid, such as hot melt adhesive, to module 10. Lower body portion 18 is secured to central body portion 14 by respective pairs of fasteners 24, 26. A nozzle assembly or die tip assembly 28 receives liquid and pressurized air from respective supply passages. Nozzle assembly 28 is secured to lower body portion 18 and includes a nozzle or die tip 30. Fasteners 33 secure nozzle 30 to lower body portion 18. Module or applicator 10 is preferably of the on/off type and includes internal valve structure for selectively dispensing liquid, such as hot melt adhesive or other viscous liquid typically formed from polymeric material, in the form of one or more filaments. A suitable module structure usable in connection with nozzle 30 is part no. 309637 available from Nordson Corporation, Westlake, Ohio, which is the assignee of the present invention.

Referring first to FIGS. 2-8, a nozzle 30 is shown constructed in accordance with the preferred embodiment. Nozzle 30 includes a body 32 preferably formed from a metal such as brass and having a front surface 34, a rear surface 36, an upper surface 38 and a lower surface 40. A V-shaped notch 42 is formed in lower surface 40 and is generally defined by a pair of converging opposided sidewalls 42*a*, 42*b*. Notch 42 serves as a guide to direct an infed strand 44 of substrate material past air and liquid outlets of nozzle body 32. Rear surface 36 is adapted to be secured against the face of a dispenser and receives liquid material, such as hot melt adhesive, through a liquid inlet port 46 extending into body 32. Liquid inlet port 46 further communicates with a liquid discharge passage 48 having a longitudinal axis 48*a* extending in a plane which includes a centerline 43 of notch 42. In the exemplary embodiment shown, axis 48*a* forms an angle of 37° to lower surface 40. The liquid discharge passage 48 thus forms an acute angle with rear surface 36. In another exemplary embodiment, the angle between the liquid discharge passage and the rear surface 36 is approximately 60° to 80°. An outlet 48*b* of liquid discharge passage 48 is located in a semi-circular recess 54 formed into front surface 34 proximate the apex of notch 42. The liquid discharge outlet 48*b* is at the apex of a frustoconical protrusion 56 that extends from semi-circular recess 54 in a direction along axis 48*a*. Air inlet recesses 50, 52 are formed into rear surface 36 and communicate with four air discharge passages 60, 62, 64, 66 extending along respective axes 60*a*, 62*a*, 64*a*, 66*a*.

Figure 3:
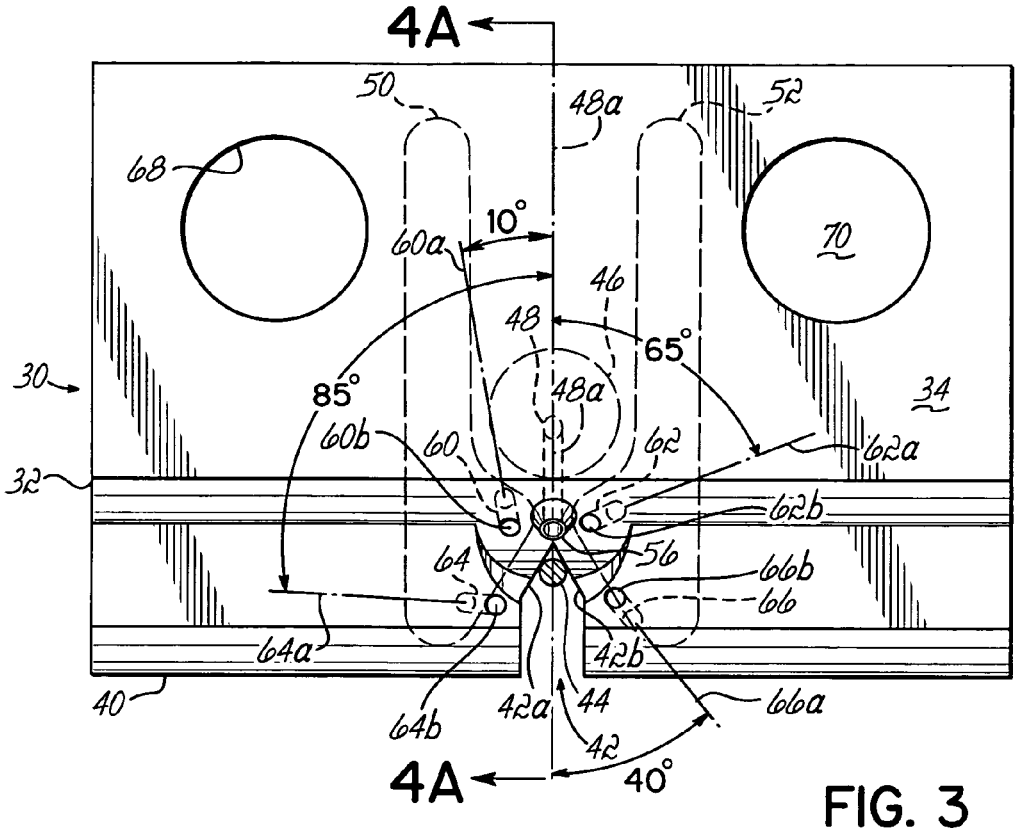
FIG. 3 is a front elevational view showing the discharge portion of the nozzle or die tip.
Figure 4A:
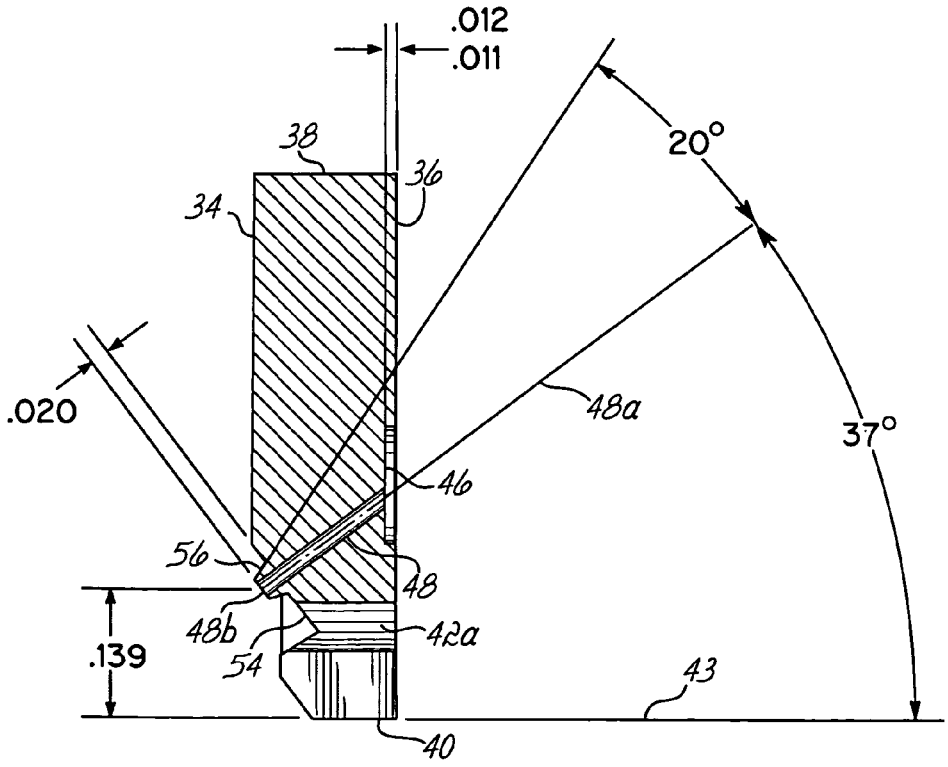
FIG. 4A is a cross-sectional view of the nozzle or die tip taken along line 4A-4A of FIG. 3.
Figure 4:
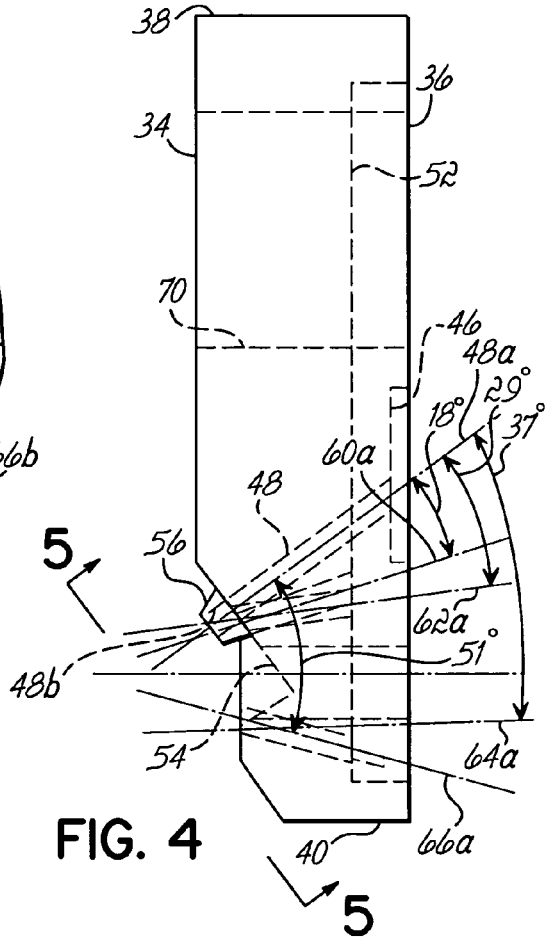
FIG. 4 is a side elevational view of the nozzle or die tip.
Figure 6:
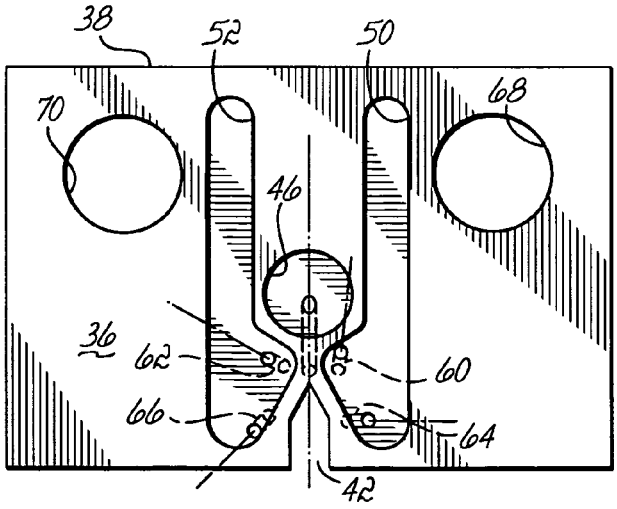
FIG. 6 is a rear elevational view of the nozzle or die tip.
Figure 7:
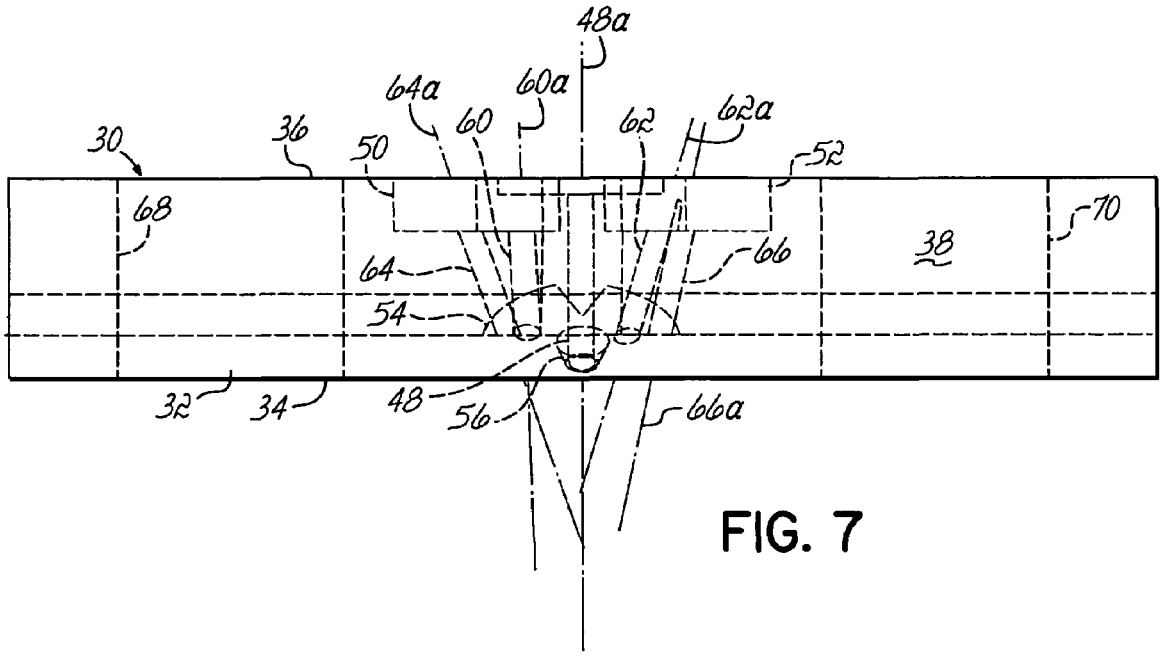
FIG. 7 is a top view of the nozzle or die tip.

Air discharge passages 60, 62, 64, 66 exit at outlets 60*b*, 62*b*, 64*b*, 66*b* on front surface 34 and on semi-circular recess 54, adjacent liquid discharge outlet 48*b* best shown in FIGS. 3 and 4. Air discharge passages 60, 62, 64, 66 discharge pressurized air generally toward axis 48*a* of liquid discharge passage 48, with compound angles best comprehended by reviewing both FIGS. 3-5. Holes 68, 70 extend through body 32 for receiving fasteners 33 (FIG. 1) used to secure nozzle 30 to a dispenser.

As viewed from the front surface 34 of nozzle body 32 (FIG. 3), axes 60*a*, 64*a* of air discharge passages 60, 64 are disposed at approximately 10° and 85°, respectively, from the axis 48*a* of liquid discharge passage 48. Axes 62*a*, 66*a* of passages 62, 66 are disposed at approximately 65° and 40° from axis 48*a*, as measured from lower surface 40. As viewed from the side of nozzle body 32, the axes 60*a*, 62*a*, 64*a*, 66*a* of air discharge passages 60, 62, 64, 66 form angles of approximately 18°, 29°, 37°, and 51° with axis 48*a* of liquid discharge passage 48 as best depicted in FIG. 4.

The four discharge outlets 60*b*, 62*b*, 64*b*, 66*b* have centers which are positioned along a common radius from a point corresponding to the location of a substrate received into notch 42. In an exemplary embodiment, the centers of air discharge outlets 60*b*, 62*b*, 64*b*, and 66*b* are positioned along a radius located from a point which is 0.027-inch from the apex of notch 42 when notch 42 has converging side walls 42*a* and 42*b* separated by an angle of 60°. This corresponds to a strand 44 having a cross sectional diameter of 0.031 inch.

Figure 5:
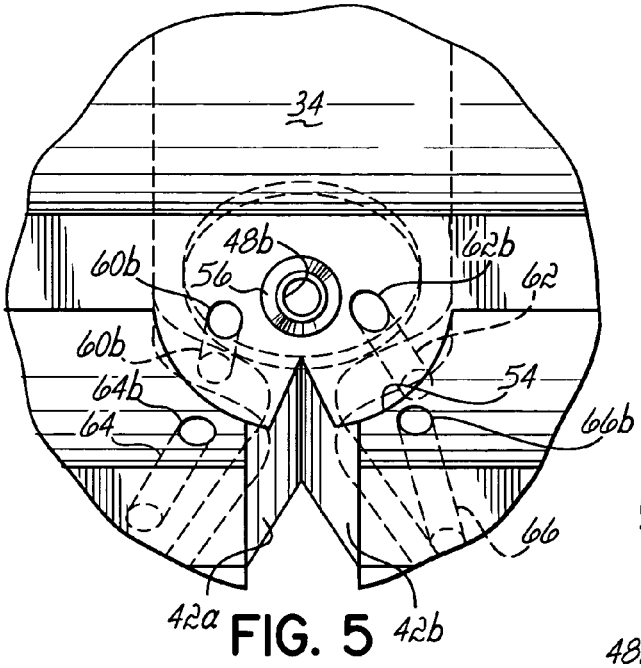
FIG. 5 is an enlarged view of the nozzle discharge portion shown in FIG. 3.

The four discharge outlets 60*b*, 62*b*, 64*b*, 66*b* are arranged to form a generally square pattern below the liquid discharge outlet 48*b* when viewed along axis 48*a*, as depicted in FIG. 5. It will be appreciated that air discharge outlets in other numbers, orientations and positions may be used instead, depending on the desired liquid discharge pattern. Pressurized air from air discharge outlets 60*b*, 62*b*, 64*b*, 66*b* is directed in directions generally tangential to the liquid filament discharging from passage 48, as opposed to directly impacting the filament discharging from passage 48. The size of the swirl pattern produced by pressurized air from air discharge outlets 60*b*, 62*b*, 64*b*, 66*b* impinging upon liquid filament as it exits liquid discharge outlet 48*b* may be adjusted by varying the angular orientation of air discharge passages 60, 62, 64, 66.

FIGS. 1 and 2 illustrate operation of an exemplary nozzle of the present invention and a swirl pattern which is produced by the exemplary nozzle. A substrate in the form of a strand 44 is received into notch 42 and moves in a direction indicated by the arrow 72. As the strand 44 passes beneath liquid discharge outlet 48*b*, a liquid filament 74 is dispensed from the outlet 48*b* generally also in the direction of arrow 72, but with a downward angle as well, and deposited on the strand 44. Jets of pressurized air from air discharge outlets 60*b*, 62*b*, 64*b*, and 66*b* are directed generally tangentially toward the liquid filament 74, as depicted by arrows 76, 78, 80, 82 in FIG. 2. The jets of pressurized air cause the liquid filament 74 to move in a swirling motion as it is deposited on the strand 44. After the filament 74 has been deposited on the strand 44, portions of the liquid filament 74 may be drawn by gravity and/or centrifugal forces to wrap around the substrate 44.

Figure 8:
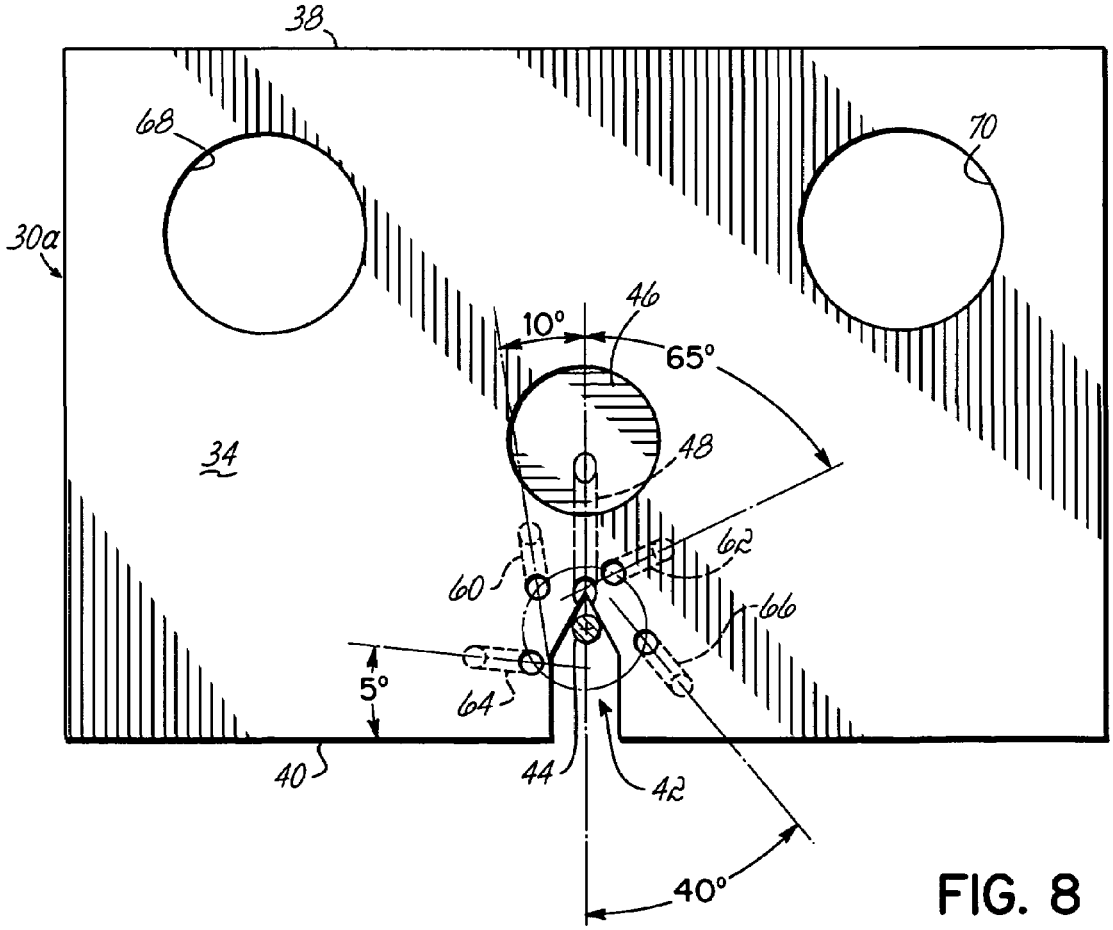
FIG. 8 is a front elevation view of an alternative nozzle or die tip in accordance with the invention.

FIG. 8 illustrates one of many possible alternative configurations for a nozzle or die tip 30'. In this regard, the front face of nozzle 30' is a flat surface and is not beveled or inset to angle the various passages downwardly as in the first embodiment. All other reference numbers are identical as between FIGS. 1-7 and FIG. 8 and the description thereof may be referred to above for an understanding of this embodiment as well.

Figure 9:
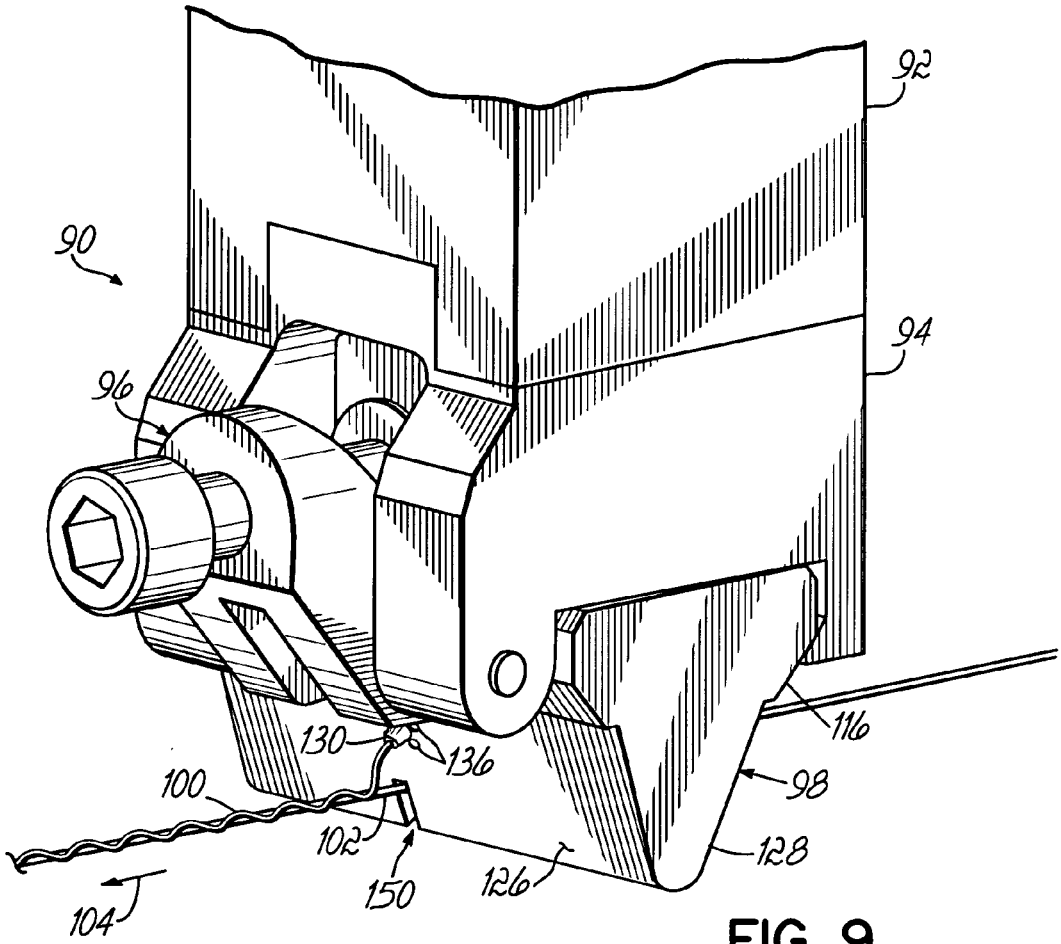
FIG. 9 is a perspective view of another exemplary dispensing module and nozzle of the present invention.

Referring to FIGS. 9-14, there is shown another exemplary dispensing module 90 and nozzle 98 according to the present invention. The dispensing module 90 depicted in FIG. 9 is similar to the exemplary dispensing module 10 of FIG. 1, having a central body portion 92 and a lower body portion 94, but further including a quick disconnect mechanism 96 for facilitating the installation and removal of various nozzles or dies from the dispensing module 90, as more fully described in U.S. Pat. No. 6,619,566 which issued on Sep. 16, 2003 and is assigned to the assignee of the present invention. FIG. 9 further illustrates another exemplary nozzle 98 coupled to the dispensing module 90 and secured with the quick disconnect mechanism 96. Nozzle 98 receives liquid and pressurized air from the dispensing module 90 and dispenses a filament of liquid material 100 in a controlled pattern to a strand of substrate material 102 moving relative to the die 98, generally in the direction of arrow 104, in a manner similar to that described above with respect to nozzle 30.

Figure 10:
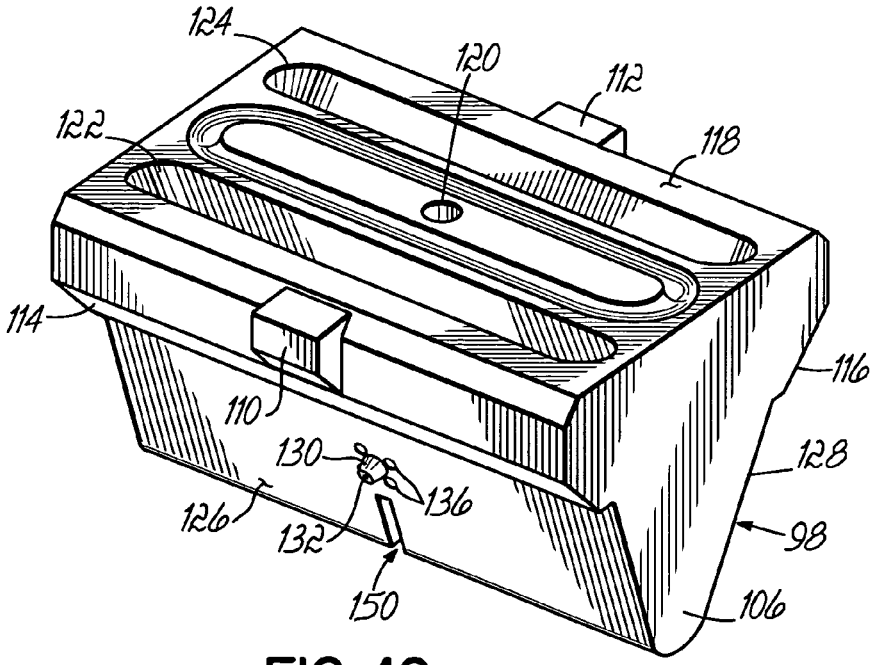
FIG. 10 is a perspective view of the nozzle of FIG. 9.
Figure 11:
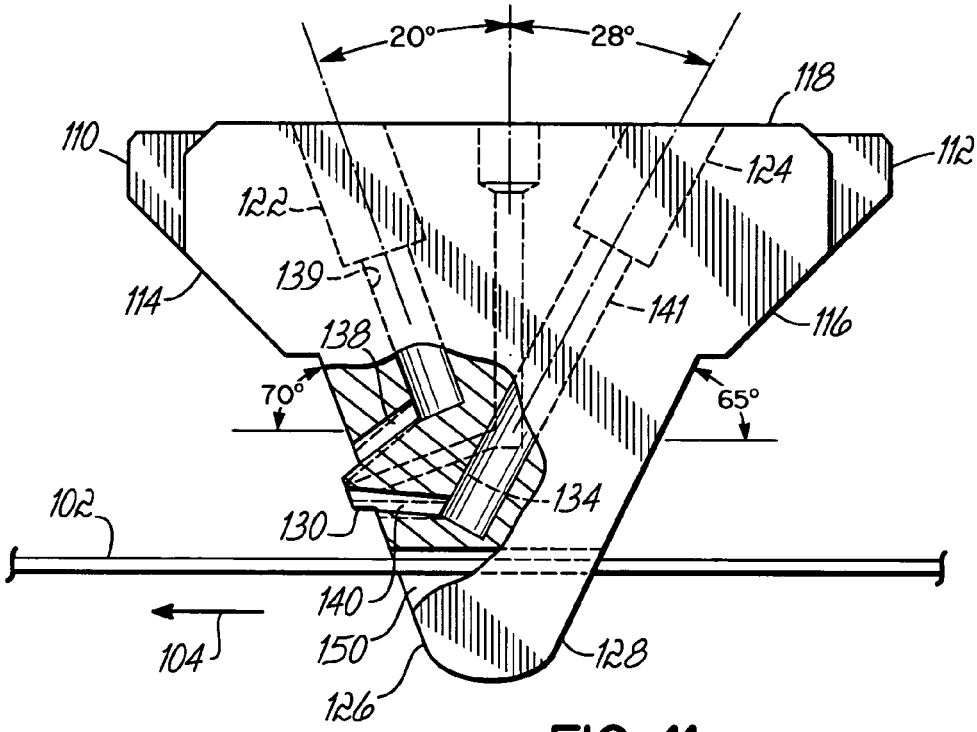
FIG. 11 is a side view of the nozzle of FIG. 10, depicting air and liquid passages of the nozzle.
Figure 12:
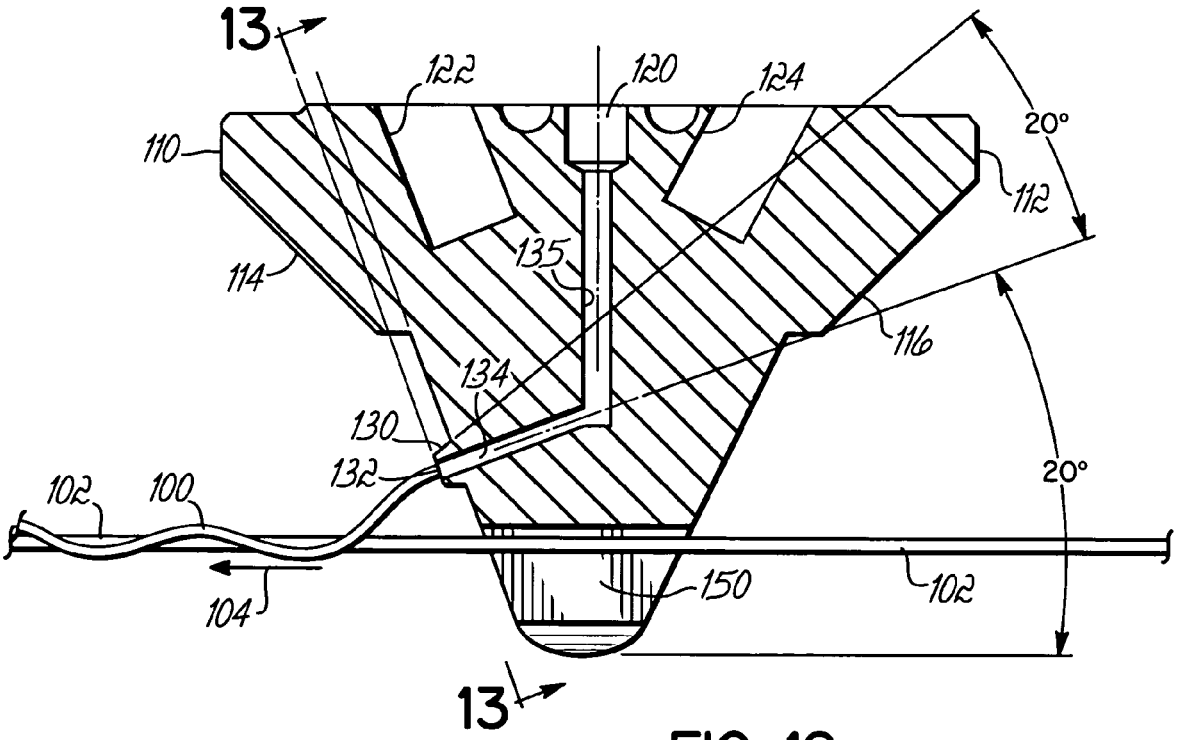
FIG. 12 is a cross-sectional view of the nozzle of FIG. 10, through the center the nozzle.

Referring now to FIG. 10, the exemplary nozzle 98 is shown in more detail. Nozzle 98 comprises a nozzle body 106 and includes protrusions 110, 112 and angled cam surfaces 114, 116, as more fully described in U.S. Pat. No. 6,619,566 to facilitate coupling the nozzle 98 with the dispensing module 90. The nozzle body 106 includes a first side 118 configured to mount to the lower portion 94 of the dispensing module 90. The first side 118 includes a liquid supply port 120 and first and second process air supply ports 122, 124 which mate to corresponding liquid and air supply passages in the dispensing module 90 in a manner similar to that described above for module 10. As depicted in FIGS. 10-12, the exemplary nozzle body 106 has a generally wedge-shaped cross-section including second and third sides 126, 128. A frustoconically-shaped protrusion 130 extends from the second side 126 of the nozzle body 106 and includes a liquid discharge outlet 132 disposed on a distal end of the protrusion 130. The liquid discharge outlet 132 is in fluid communication with a liquid discharge passage 134, which in turn is in communication with the liquid supply port 120 by way of a liquid passage 135, whereby liquid material from the module 90 may be dispensed from the liquid discharge outlet 132 to the strand 102 of substrate material as more clearly depicted in FIGS. 11 and 12. At least a portion of the liquid discharge passage 134 is oriented to form an acute angle with a plane parallel to the first side 118, and thus forms and angle with a direction corresponding to of movement of the strand 102, generally indicated by arrow 104. The liquid discharge passage of the exemplary embodiment is inclined at approximately 20° to the first side, whereby the liquid material is dispensed from the liquid discharge outlet to the strand and generally in the direction of strand movement.

Figure 13:
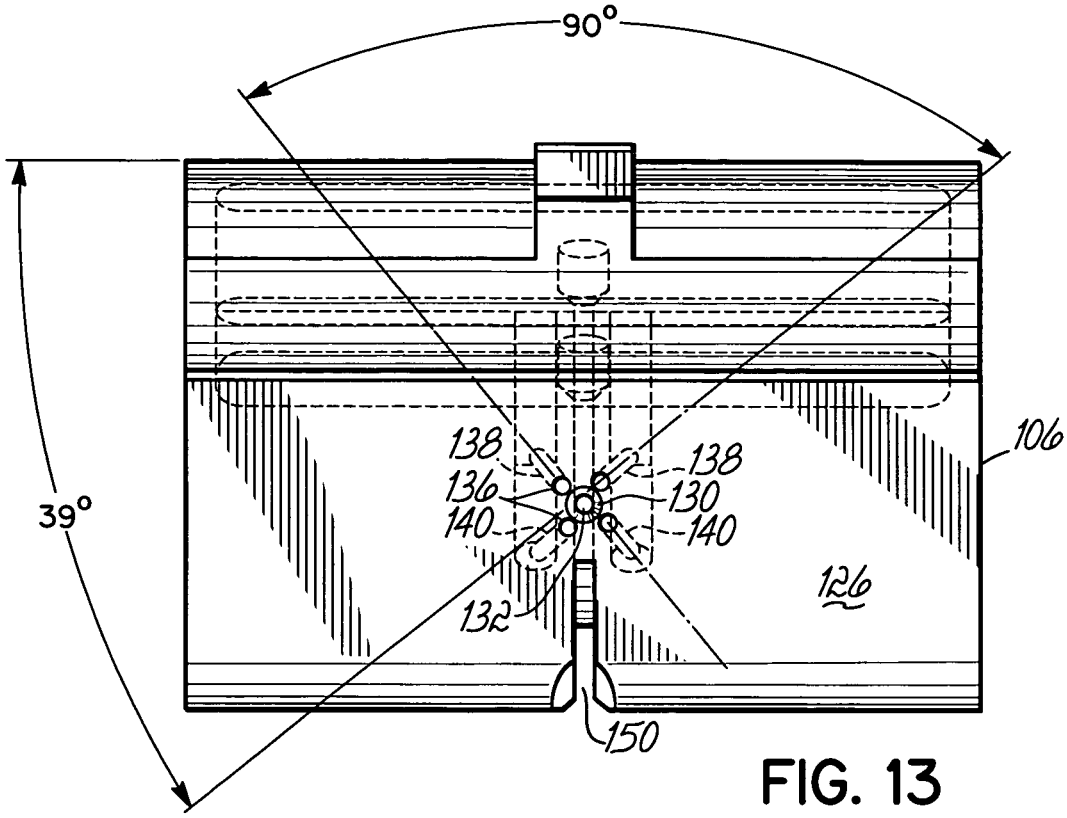
FIG. 13 is a view of the nozzle of FIG. 10, taken along lines 13-13 in FIG. 12.
Figure 14:
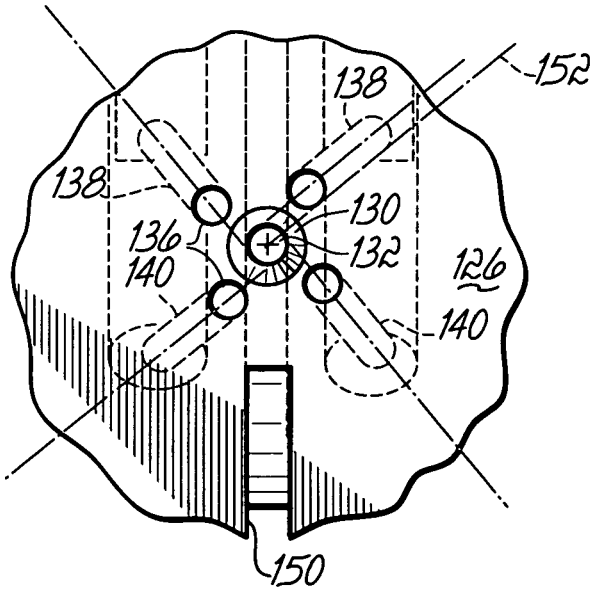
FIG. 14 is a detail view of the air and discharge outlets of FIG. 13.
Figure 15:
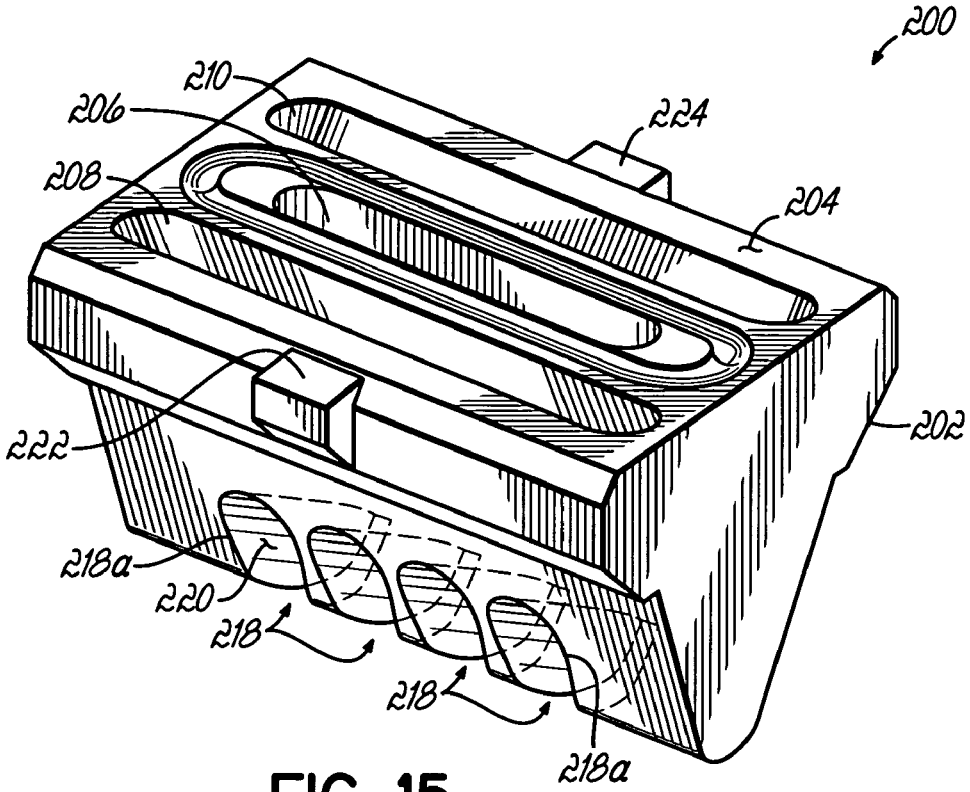
FIG. 15 is a rear perspective view of another exemplary dispensing nozzle of the present invention.
Figure 16:
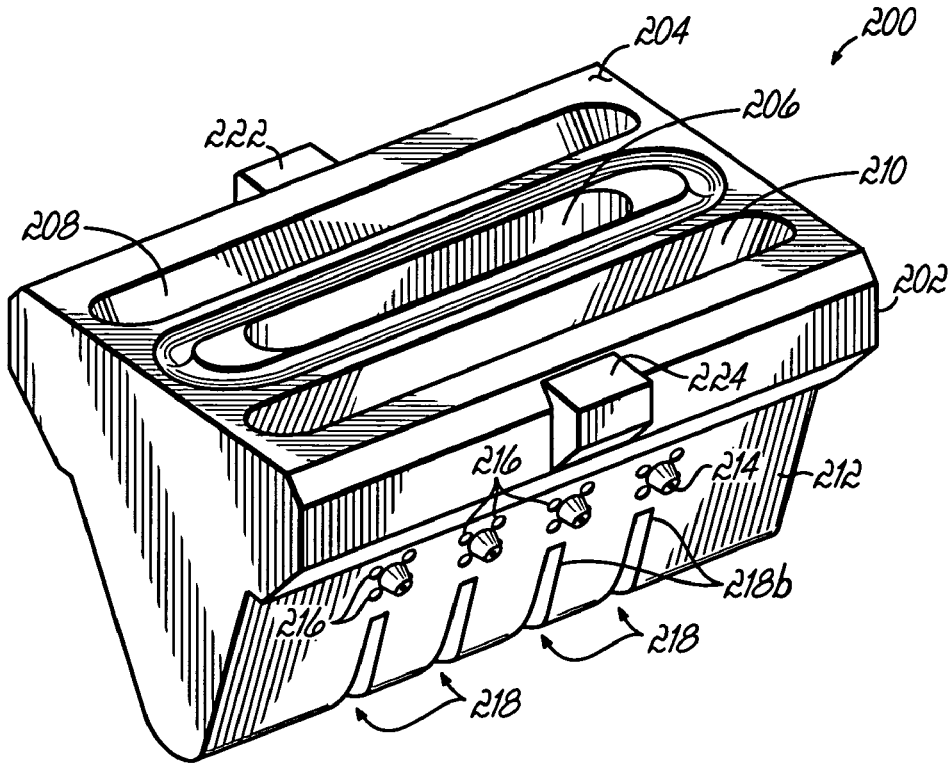
FIG. 16 is a front perspective view of the nozzle of FIG. 15.

The second side 126 of the nozzle body 106 further includes a plurality of air discharge outlets 136 proximate the liquid discharge outlet 132 and in fluid communication with air discharge passages 138, 140 by way of respective air passages 139, 141 which extend to the air supply ports 122, 124 on the first side 118 of the nozzle body 106. The air discharge passages 138, 140 of the exemplary nozzle body 106 are inclined at approximately 20° and approximately 28° from an axis through liquid passage 135. As shown in FIGS. 13 and 14, the air discharge outlets 136 are arranged generally around the base of the frustoconical protrusion 130 and are configured to direct process air toward the liquid filament 100 dispensed from the liquid discharge outlet 132 in a manner similar to that described above for nozzle 30.

In the exemplary nozzle body 106, four air discharge outlets 136 are disposed in a generally square pattern around the liquid discharge outlet 132 at the base of the frustoconical protrusion 130. Diagonally opposite air discharge passages 138, 140 or, in other words, air discharge passages disposed at opposite corners of the square-shaped pattern, are symmetric and disposed in planes that are at least nearly parallel to each other. The air discharge passages 138, 140 are each offset from axes 152 that are normal to a longitudinal axis of the liquid discharge passage 134, and each forms a true angle of approximately 30° with the longitudinal axis of the liquid discharge passage 134 such that the air stream discharged from each air discharge passage 138 is tangential to the liquid filament 100 discharged from the liquid discharge passage 134, as opposed to directly impacting the filament 100. This arrangement of air and liquid discharge passages provides a liquid filament which is moved in a controlled manner as it is dispensed from the liquid discharge passage to create a desired pattern on the strand 102 of substrate material. Variation of the pattern is possible by adjusting the offset spacing and orientation of the air discharge passages 138, 140 relative to the liquid discharge passage 134, as will be apparent to those skilled in the art.

The nozzle body 106 further includes a notch 150 formed into an end of the nozzle body 106 opposite the first side 118 and proximate the liquid discharge outlet 132 to direct the strand 102 of substrate material past the air and liquid discharge outlets 132, 136 disposed on the second side 126 of the nozzle body 106. As shown more clearly in FIGS. 11 and 12, the notch 150 extends between the second and third sides 126, 128 of the nozzle body 106. In an exemplary embodiment, the second and third sides 126, 128 are configured to form acute angles with the first side 118. In one exemplary embodiment, the second side 126 forms an angle of approximately 60-80° with the first side 118. In another aspect of the invention, the third side 128 forms an angle no greater than approximately 70° with the first side 118. Advantageously, the angle of the third side 128 facilitates the passage of knots formed in the strand 102 without causing breakage of the strand 102. These knots are typically formed in the infed strand material, for example, when the trailing end of a first length of strand material is secured to the leading end of a second length of strand material from a supply to permit continuous operation of the module 90.

Another embodiment of a nozzle 200 is shown in FIGS. 15-19. Nozzle 200 comprises a nozzle body similar to that shown in FIG. 9, but having a modified strand guide. More specifically, nozzle 200 includes a nozzle body 202 with an upper mounting surface 204 for engagement with an applicator or module (in the manner shown in FIG. 9). A liquid input channel 206 and a pair of process air input channels 208, 210 are provided as in the previous embodiment. A front surface 212 of nozzle body 202 includes a plurality of liquid discharge passages 214 and process air discharge passages 216 associated with each passage 214. Passages 214, 216 respectively communicate with inputs 206 and 208, 210 as in the previous embodiment.

Figure 17:
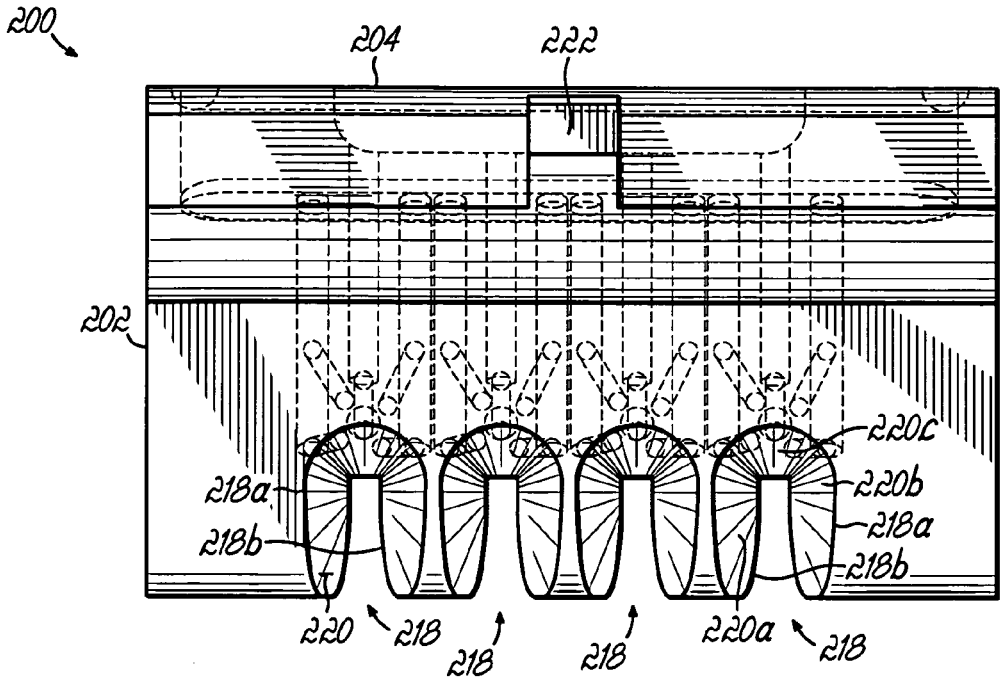
FIG. 17 is a rear elevational view of the nozzle of FIG. 15, depicting the entrance end of the strand guide notch.
Figure 18:
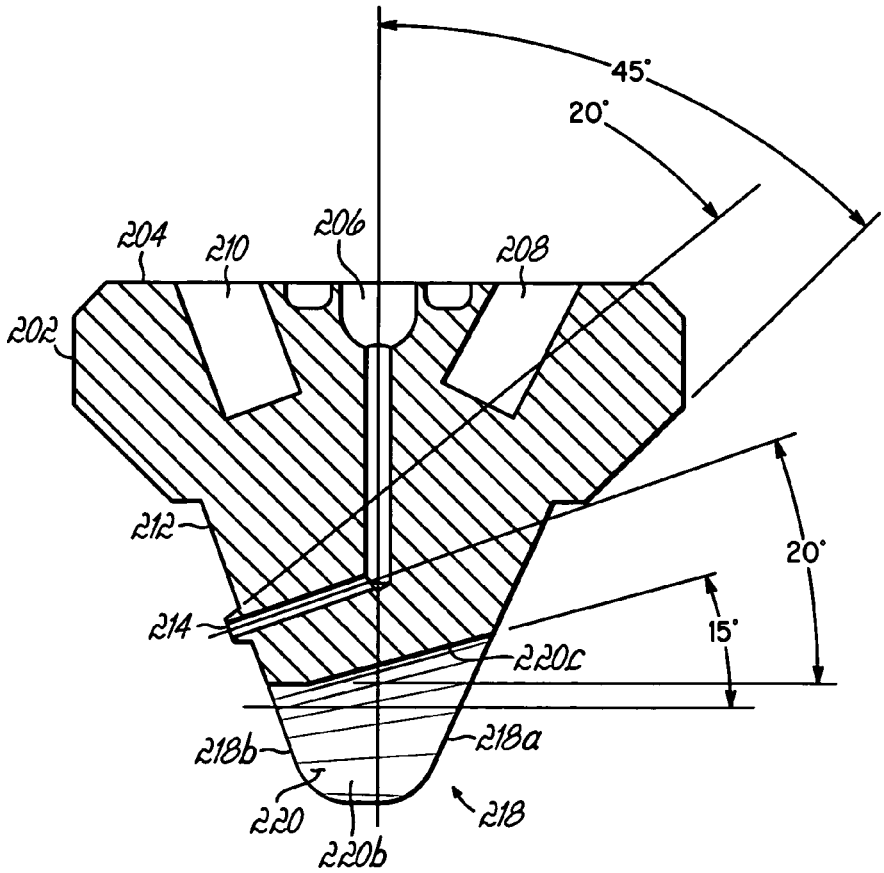
FIG. 18 is a transverse cross-sectional view of the nozzle of FIG. 15, through one of the strand guide notches.
Figure 19:
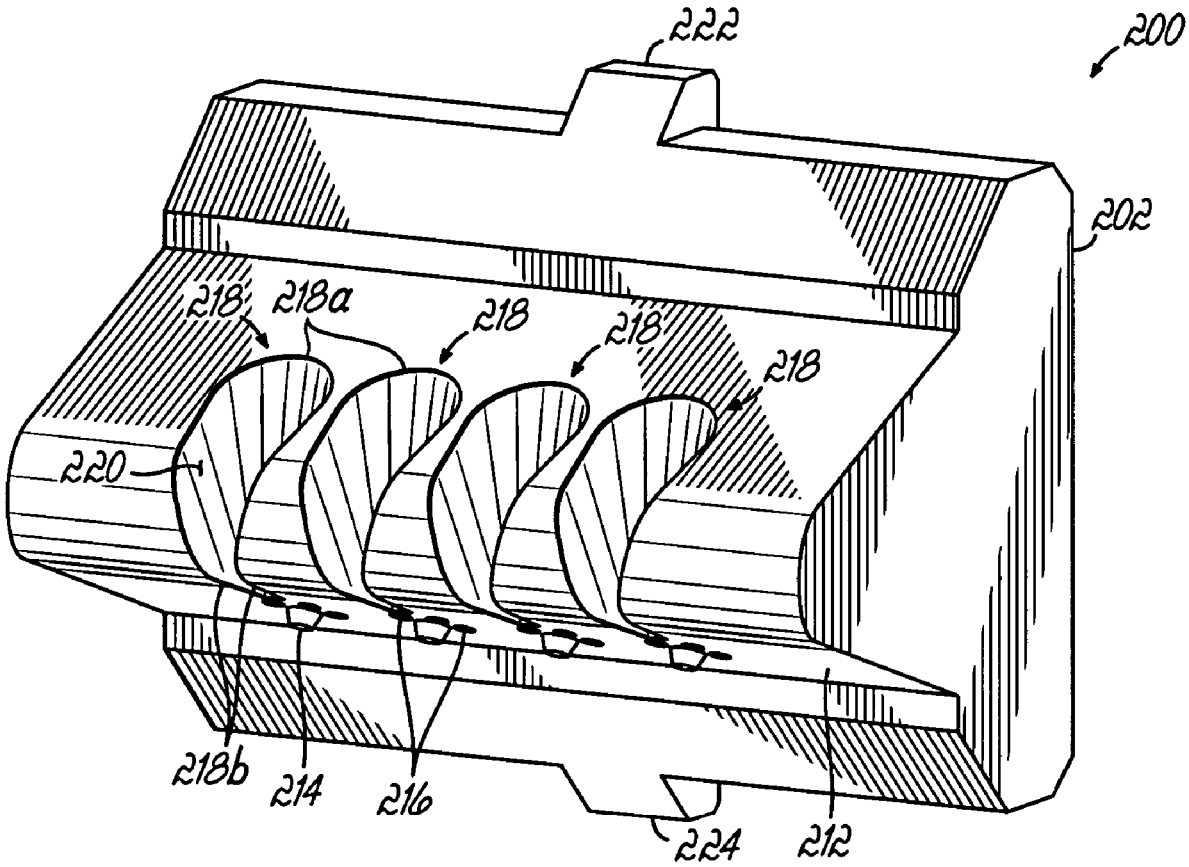
FIG. 19 is a bottom perspective view of the nozzle of FIG. 15.
Figure 20:
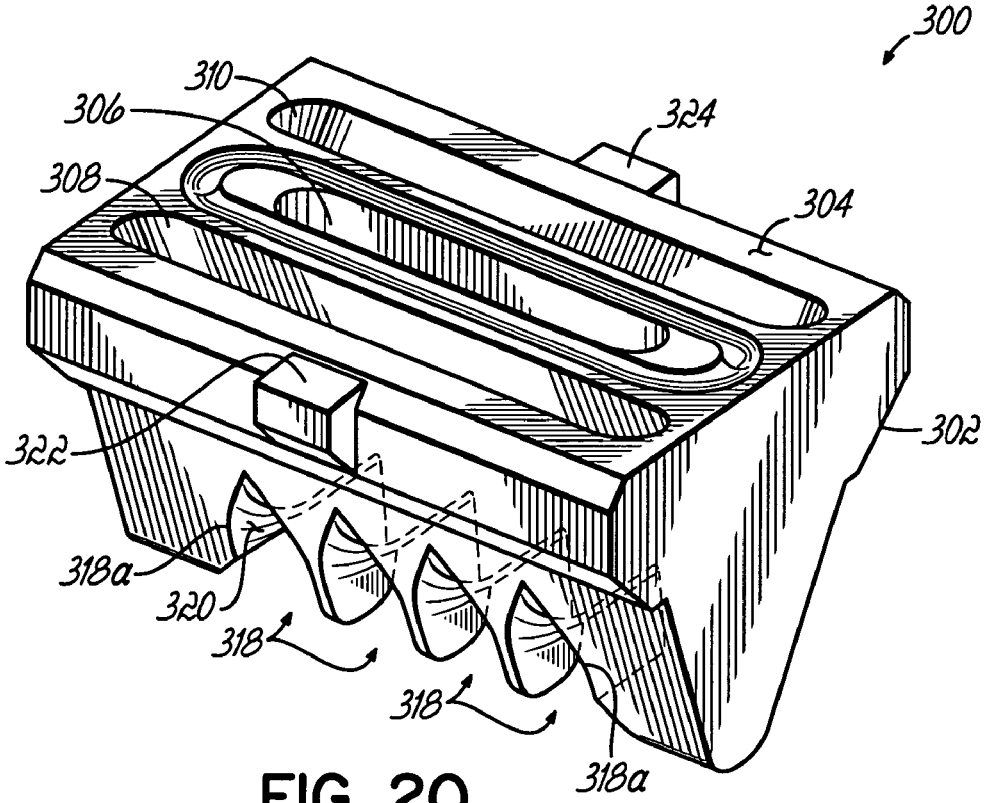
FIG. 20 is a rear perspective view of another exemplary dispensing nozzle of the present invention.
Figure 21:
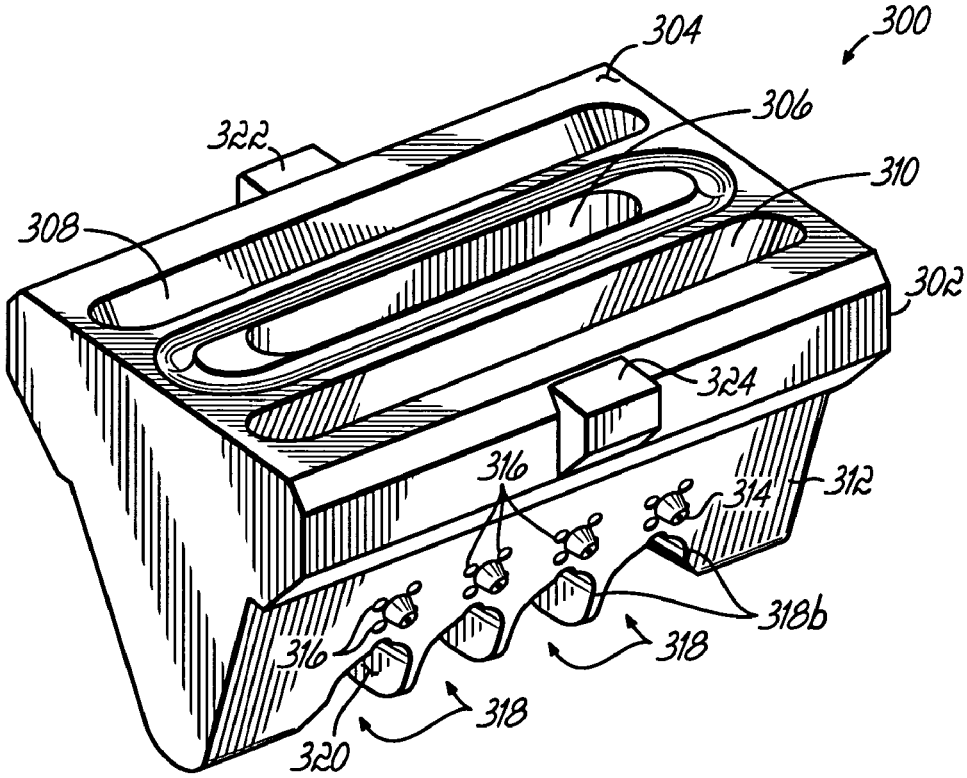
FIG. 21 is a front perspective view of the nozzle of FIG. 20.

A plurality of strand guides in the form of notches 218 receive respective strands of material, such as elastic material (not shown), to which adhesive will be applied from passages 214. Notches 218 have an entrance end 218*a* and an exit end 218*b*. Entrance end 218*a* is wider than exit end 218*b* and a concave or upwardly rounded surface 220 extends from entrance end 218*a* toward exit end 218*b*. As shown in FIG. 17, strand guide surface 220 includes concave side surface portions 220*a*, 220*b* and an upper concave surface portion 220*c*. As shown in FIG. 18, surface 220 is preferably angled from front to back as shown by, for example, 15° with respect to horizontal. Nozzle body 202 further includes protrusions 222, 224 for the same connection purposes as in the previous embodiment. As a strand moves through guide notch 218, it is centered within the notch by the curved sidewalls 220*a*, 220*b* such that the strand is positioned directly below liquid discharge passage 214 upon exit from notch 218.

It will be appreciated by persons of ordinary skill in the art that the number of strands receiving adhesive from a corresponding one of passages 214 is equal to the number of strand guides or notches 218, according to the particular dispensing application. The invention contemplates that nozzle 200 may incorporate a single notch 218 for applying adhesive to a single strand or multiple notches 218 for applying adhesive to multiple different strands, as illustrated in FIGS. 15-19.

Another embodiment of a nozzle 300 is shown in FIGS. 20-24. Nozzle 300 comprises a nozzle body similar to that shown in FIGS. 15-19, but having a modified strand guide. More specifically, nozzle 300 includes a nozzle body 302 with an upper mounting surface 304 for engagement with an applicator or module (in the manner shown in FIG. 9). A liquid input channel 306 and a pair of process air input channels 308, 310 are provided as in the embodiments described above. A front surface 312 of nozzle body 302 includes a plurality of liquid discharge passages 314 and process air discharge passages 316 associated with each liquid discharge passage 314. Passages 314, 316 respectively communicate with inputs 306 and 308, 310 as in the previous embodiments.

Figure 22:
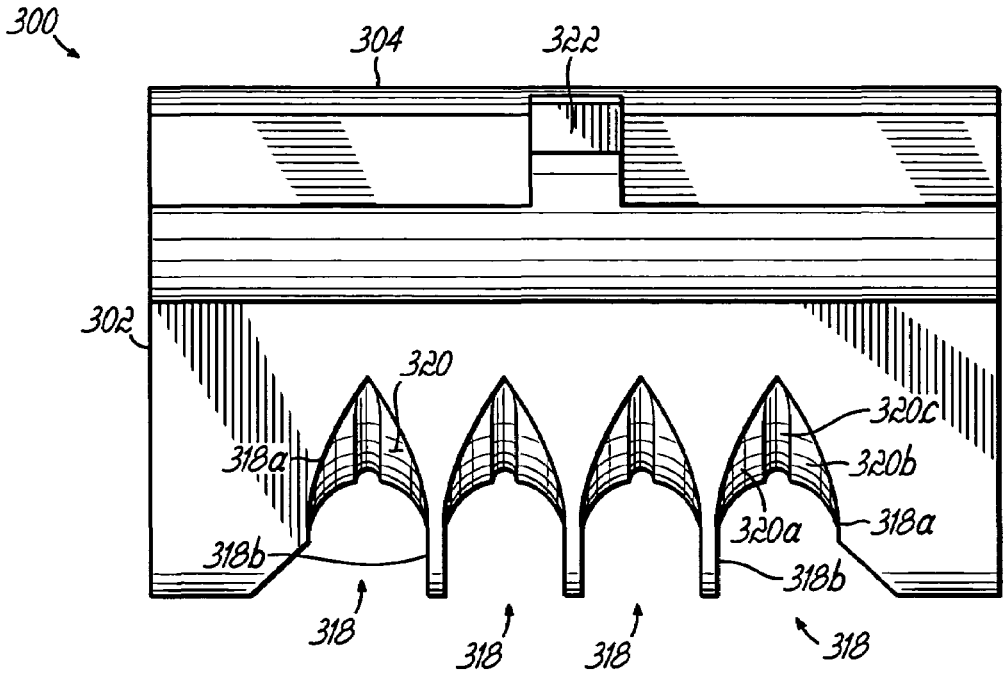
FIG. 22 is a rear elevational view of the nozzle of FIG. 20, depicting the entrance end of the strand guide notch.
Figure 23:
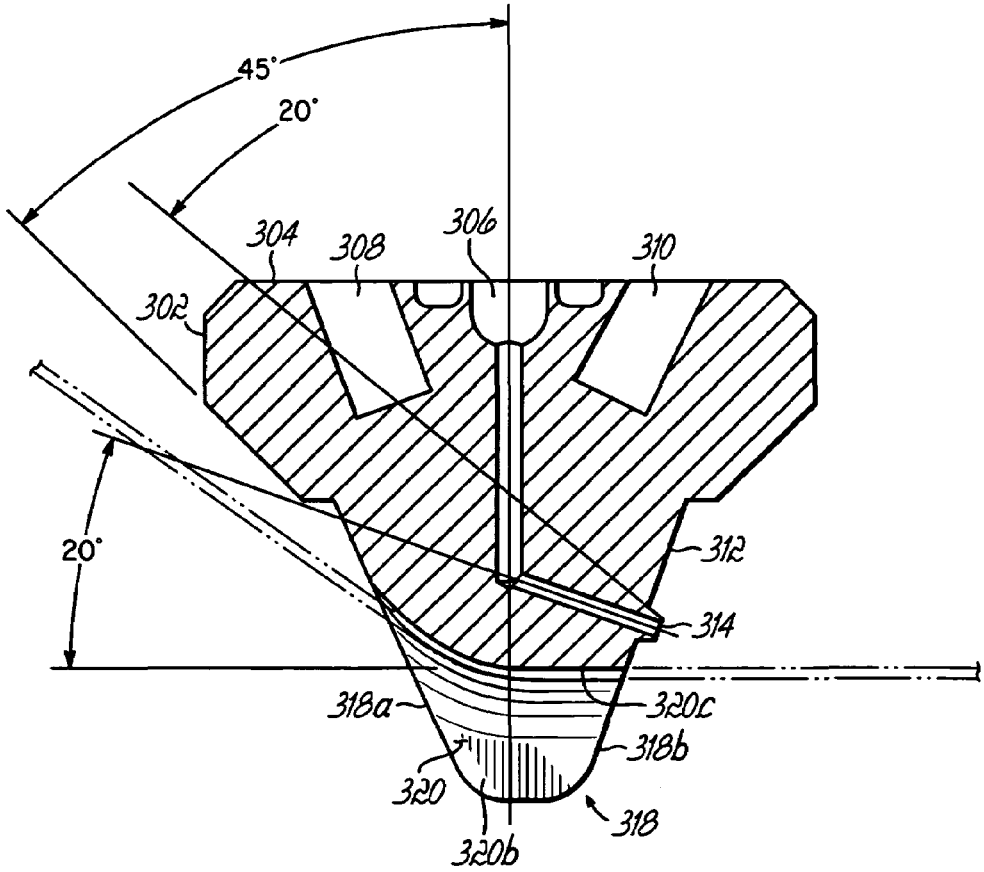
FIG. 23 is a transverse cross-sectional view of the nozzle of FIG. 20, through one of the strand guide notches.
Figure 24:
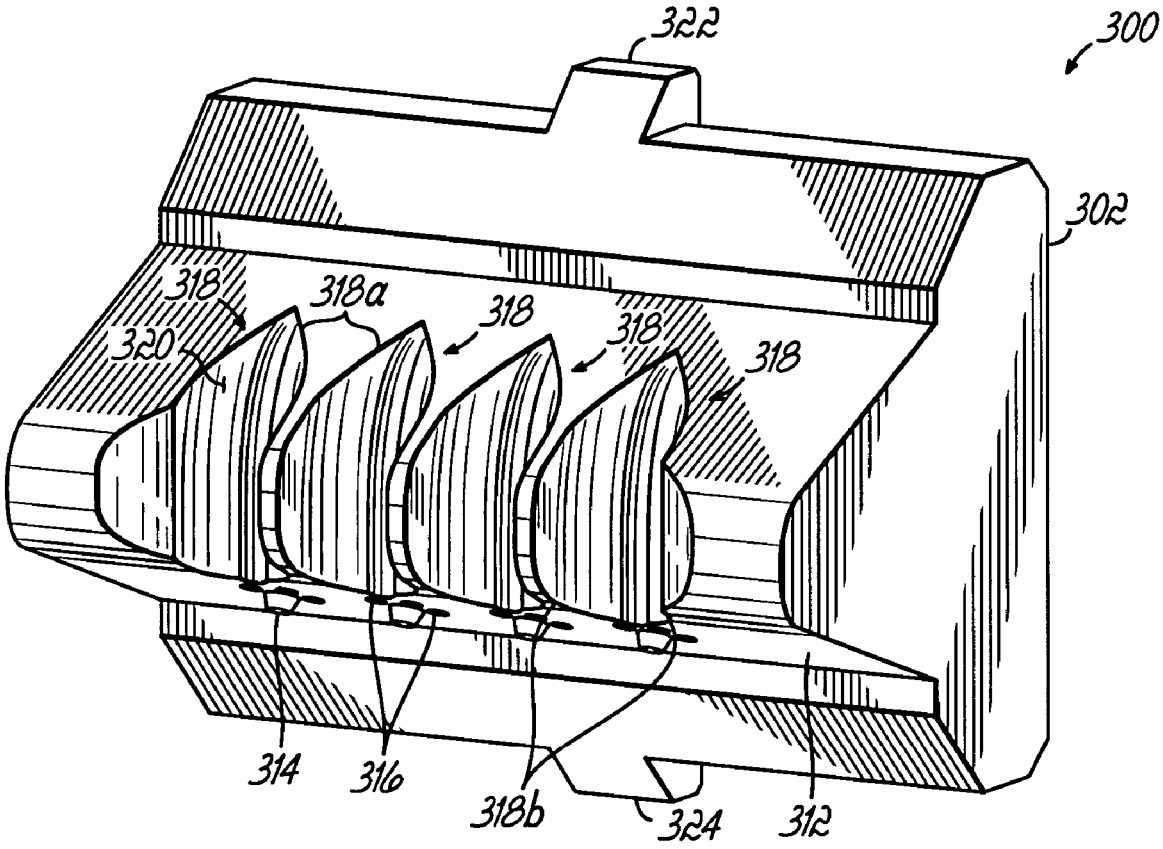
FIG. 24 is a bottom perspective view of the nozzle of FIG. 20.

A plurality of strand guides in the form of notches 318 receive respective strands of material, such as elastic material 102 (FIG. 23), to which adhesive will be applied from passages 314. Notches 318 have an entrance end 318*a* and an exit end 318*b*. Entrance end 318*a* may be wider than exit end 318*b* as in the previous embodiment, or the entire notch 318 may be widened as shown in FIGS. 20-24 to further prevent dust and/or contaminant build up. A concave or upwardly rounded surface 320 extends from entrance end 318*a* toward exit end 318*b*. As shown in FIG. 22, strand guide surface 320 includes concave side surface portions 320*a*, 320*b* and an upper concave, recess portion 320*c*. As shown in FIG. 23, surface 320 is preferably angled with a smooth curve from front to back as shown. This will allow the strand 102 to enter notch 318 at an angle of about 15° to about 45° with respect to horizontal, although other strand angles may be accommodated as well, with or without modification to notch 318. Nozzle body 302 further includes protrusions 322, 324 for the same connection purposes as in the previous embodiment. As a strand moves through guide notch 318, it is centered within the notch by the curved sidewalls 320*a*, 320*b*, and within the central elongate recess 320*c*, such that the strand 102 (FIG. 23) is positioned directly below liquid discharge passage 314 upon exit from notch 318. Notch 318 allows free passage of airborne contaminants to pass through nozzle 300 without creating build up which might lead to strand breakage.

Again, it will be appreciated by persons of ordinary skill in the art that the number of strands receiving adhesive from a corresponding one of passages 314 is equal to the number of strand guides or notches 318, according to the particular dispensing application. The invention contemplates that nozzle 300 may incorporate a single notch 318 for applying adhesive to a single strand or multiple notches 318 for applying adhesive to multiple different strands, as illustrated in FIGS. 20-24.

While the present invention has been illustrated by a description of various preferred embodiments and while these embodiments has been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims, wherein

What is claimed is:

1. A nozzle for dispensing a controlled pattern of liquid material onto a moving strand, comprising:

a nozzle body including a liquid supply port and a process air supply port, a liquid discharge outlet connected in fluid communication with said liquid supply port, and a plurality of process air discharge outlets connected in fluid communication with said process air supply port;

a mounting surface configured for mounting said nozzle body to a valve module; and a strand guide including a notch for receiving the strand, said notch positioned proximate to said liquid discharge outlet and including a rounded, concave surface to receive and guide the strand along a path of movement, said notch including an entrance end and an exit end and said rounded, concave surface being stationary relative to said nozzle body and angled in a direction from said entrance end to said exit end to permit a plurality of alternative approach angles of the strand as the strand moves through said entrance end.

2. The nozzle of claim 1, wherein said nozzle body further comprises:

a plurality of liquid discharge outlets connected in fluid communication with said liquid supply port, said liquid discharge outlets adapted to discharge the liquid material onto a corresponding plurality of strands; and a plurality of air discharge outlets associated with each liquid discharge outlet, said air discharge outlets connected in fluid communication with said process air supply port;

and wherein said strand guide further comprises a plurality of notches respectively positioned proximate said plurality of liquid discharge outlets, each said notch including a rounded, concave surface to receive and guide the movement of one of the plurality of strands.

3. The nozzle of claim 1, wherein said rounded, concave surface curves in a direction transverse to the path of movement.

4. The nozzle of claim 1, wherein said rounded, concave surface curves in a direction parallel to the path of movement.

5. The nozzle of claim 1, wherein said rounded, concave surface curves in a direction transverse to the path of movement and curves in a direction parallel to the path of movement.

6. A dispensing module for dispensing a controlled pattern of liquid material onto a strand, comprising:

a module body including a lower body portion;

a nozzle body coupled to said lower body portion and including a liquid supply port, a process air supply port, a liquid discharge outlet, a plurality of air discharge outlets, a liquid discharge passage connected in fluid communication with said liquid supply port and said liquid discharge outlet, and a plurality of process air discharge passages connected in fluid communication with said process air supply port and said plurality of air discharge outlets; and a strand guide including a notch positioned proximate to said liquid discharge outlet and including a rounded, concave surface to receive and guide the strand along a path of movement, said notch including an entrance end and an exit end and said rounded, concave surface being stationary relative to said nozzle body and angled in a direction from said entrance end to said exit end to permit a plurality of alternative approach angles of the strand as the strand moves through said entrance end.

7. The module of claim 6, wherein said rounded, concave surface curves in a direction transverse to the path of movement.

8. The module of claim 6, wherein said rounded, concave surface curves in a direction parallel to the path of movement.

9. The module of claim 6, wherein said rounded, concave surface curves in a direction transverse to the path of movement and curves in a direction parallel to the path of movement.

10. The module of claim 6, further comprising an elongate recess extending along the path of movement within said notch, said elongate recess sized to receive and guide the strand along the path of movement.

11. The module of claim 6, further comprising an elongate recess extending along the path of movement within said notch, said elongate recess sized to receive and guide the strand along the path of movement.

12. The module of claim 6, wherein said nozzle body further comprises:

a plurality of liquid discharge outlets connected in fluid communication with said liquid supply port, said liquid discharge outlets adapted to discharge the liquid material onto a corresponding plurality of strands; and a plurality of air discharge outlets associated with each liquid discharge outlet, said air discharge outlets connected in fluid communication with said process air supply port;

and wherein said strand guide further comprises a plurality of notches respectively positioned proximate said plurality of liquid discharge outlets, each said notch including a rounded, concave surface to receive and guide the movement of one of the plurality of strands.

13. A nozzle for dispensing a controlled pattern of liquid material onto a moving strand, comprising:

a nozzle body including a liquid supply port and a process air supply port, a liquid discharge outlet connected in fluid communication with said liquid supply port, and a plurality of process air discharge outlets connected in fluid communication with said process air supply port;

a mounting surface configured for mounting said nozzle body to a valve module; and a strand guide including a notch for receiving the strand, said notch positioned proximate to said liquid discharge outlet and including a rounded, concave surface to receive and guide the strand, said notch including an entrance end and an exit end, and an elongate recess formed in said rounded, concave surface for receiving the strand and guiding the strand through said notch, said rounded, concave surface being stationary relative to said nozzle body and angled in a direction from said entrance end to said exit end to permit a plurality of alternative approach angles of the strand as the strand moves through said entrance end.

14. A dispensing module for dispensing a controlled pattern of liquid material onto a strand, comprising:

a module body including a lower body portion;

a nozzle body coupled to said lower body portion and including a liquid supply port, a process air supply port, a liquid discharge outlet, a plurality of air discharge outlets, a liquid discharge passage connected in fluid communication with said liquid supply port and said liquid discharge outlet, and a plurality of process air discharge passages connected in fluid communication with said process air supply port and said plurality of air discharge outlets; and a strand guide including a notch positioned proximate to said liquid discharge outlet and including a rounded, concave surface to receive and guide the strand, said notch including an entrance end and an exit end, and an elongate recess formed in said rounded, concave surface for receiving the strand and guiding the strand through said notch, said rounded, concave surface being stationary relative to said nozzle body and angled in a direction from said entrance end to said exit end to permit a plurality of alternative approach angles of the strand as the strand moves through said entrance end.

* * * * *

UNITED STATES PATENT AND TRADEMARK OFFICE

CERTIFICATE OF CORRECTION

PATENT NO. : 7,578,882 B2
APPLICATION NO. : 10/760911
DATED : August 25, 2009
INVENTOR(S) : Harris et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1201 days.

Signed and Sealed this

Fourteenth Day of September, 2010

David J. Kappos

David J. Kappos
*Director of the United States Patent and Trademark Office*